US009545987B1

(12) United States Patent
Przybyl et al.

(10) Patent No.: US 9,545,987 B1
(45) Date of Patent: Jan. 17, 2017

(54) TRACTION CONTROL SYSTEMS AND METHODS FOR MARINE VESSELS

(71) Applicant: Brunswick Corporation, Lake Forest, IL (US)

(72) Inventors: Andrew J. Przybyl, Berlin, WI (US); David M. Van Buren, Fond du Lac, WI (US); Brad E. Taylor, Guthrie, OK (US); Kenneth G. Gable, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 460 days.

(21) Appl. No.: 14/268,615

(22) Filed: May 2, 2014

(51) Int. Cl.

| | |
|---|---|
| ***B63H 25/00*** | (2006.01) |
| ***B63H 25/04*** | (2006.01) |
| ***B63H 21/21*** | (2006.01) |
| ***F02D 25/00*** | (2006.01) |
| ***B63H 25/24*** | (2006.01) |

(52) U.S. Cl.
CPC ..... *B63H 25/04* (2013.01); *B63H 21/21* (2013.01); *B63H 25/24* (2013.01); *F02D 25/00* (2013.01)

(58) Field of Classification Search
CPC ..... F02D 25/00; F02D 25/02; F02D 27/00; F02D 27/02; F02D 29/02; B63H 25/00; B63H 25/24; B63H 25/26; B63H 25/42; B63H 25/14; B63H 21/21; B63H 2025/026; B63H 25/04
See application file for complete search history.

(56) References Cited

U.S. PATENT DOCUMENTS

| | | | | |
|---|---|---|---|---|
| 3,294,054 | A * | 12/1966 | Norton | B63H 25/10 440/60 |
| 3,788,267 | A | 1/1974 | Strong | |
| 4,781,632 | A | 11/1988 | Litjens et al. | |
| 4,792,313 | A | 12/1988 | Meisenburg | |
| 4,911,665 | A | 3/1990 | Hetzel | |
| 4,964,276 | A * | 10/1990 | Sturdy | F02D 25/02 60/700 |

(Continued)

FOREIGN PATENT DOCUMENTS

| | | |
|---|---|---|
| JP | 60-209389 | 10/1985 |
| WO | 2008/155448 | 12/2008 |
| WO | 2013/127928 | 9/2013 |

*Primary Examiner* — Thomas Moulis
(74) *Attorney, Agent, or Firm* — Andrus Intellectual Property Law, LLP

(57) ABSTRACT

A traction control system is for a marine vessel. The traction control system comprises a first internal combustion engine that causes rotation of a first propulsor to thereby propel the marine vessel in the water. A second internal combustion engine causes rotation of a second propulsor to thereby propel the marine vessel in water. A sensor senses a change in operation of the first internal combustion engine that is indicative of a loss of traction between the first propulsor and the water. A control circuit is programmed to temporarily slow rotation of the first propulsor when the sensor senses the change in operation of the first internal combustion engine, thereby allowing the first propulsor to regain traction with the water. When the control circuit slows rotation, the control circuit is further programmed to temporarily slow rotation of the second internal combustion engine, thereby preventing unintended movement of the marine vessel.

20 Claims, 5 Drawing Sheets

(56) References Cited

U.S. PATENT DOCUMENTS 5,190,487 A * 3/1993 Fukui ..... B63H 1/18 416/25
5,494,466 A * 2/1996 Vernea ..... B63H 5/10 192/51
5,711,742 A 1/1998 Leinonen et al.
6,233,943 B1 * 5/2001 Beacom ..... F02B 61/045 60/706
6,234,853 B1 5/2001 Lanyi et al.
6,273,771 B1 8/2001 Buckley et al.
6,511,354 B1 1/2003 Gonring et al.
6,882,289 B2 * 4/2005 Motsenbocker ..... B63H 1/28 340/979
7,131,385 B1 11/2006 Ehlers et al.
7,267,068 B2 9/2007 Bradley et al.
7,280,904 B2 * 10/2007 Kaji ..... B63H 21/213 701/101
7,305,928 B2 12/2007 Bradley et al.
7,467,595 B1 12/2008 Lanyi et al.
7,575,490 B1 8/2009 Angel et al.
7,762,772 B1 7/2010 Alby et al.
7,762,858 B2 7/2010 Suzuki et al.
7,762,859 B2 7/2010 Suzuki et al.
7,918,696 B2 * 4/2011 Daum ..... B63H 25/42 440/1
7,931,511 B2 * 4/2011 Suzuki ..... B63H 21/213 440/1
9,248,898 B1 * 2/2016 Kirchhoff ..... B63H 21/213
2007/0017426 A1 * 1/2007 Kaji ..... B63J 99/00 114/144 RE
2008/0113570 A1 * 5/2008 Kaji ..... B63H 21/20 440/1
2009/0215329 A1 * 8/2009 Suzuki ..... B63H 21/213 440/1
2009/0247029 A1 * 10/2009 Maeda ..... B63B 35/731 440/87
2009/0287382 A1 * 11/2009 Blum ..... B63H 21/21 701/51
2010/0145558 A1 * 6/2010 Kaji ..... B63H 25/02 701/21
2010/0274420 A1 * 10/2010 Veit ..... F02D 29/02 701/21
2010/0304627 A1 * 12/2010 Morvillo ..... B63H 1/18 440/1
2011/0143610 A1 * 6/2011 Kuriyagawa ..... B63H 21/22 440/86
2011/0166724 A1 * 7/2011 Hiramatsu ..... B63H 21/213 701/21
2011/0172858 A1 * 7/2011 Gustin ..... B63H 21/213 701/21
2014/0220837 A1 * 8/2014 Kuriyagawa ..... B63H 21/21 440/1
2014/0329422 A1 * 11/2014 Ito ..... B63H 20/12 440/1

* cited by examiner

TRACTION CONTROL SYSTEMS AND METHODS FOR MARINE VESSELS

FIELD

The present disclosure relates to traction control systems and methods for marine vessels.

BACKGROUND

The following U.S. Patents provide background information regarding the present disclosure. All of these patents are incorporated herein by reference:

U.S. Pat. No. 5,711,742 discloses a marine propulsion system having an automatic multi-speed shifting mechanism such as a transmission. An electronic controller monitors engine parameters such as engine revolution speed and load, and generates a control signal in response thereto, which is used to control shifting. Engine load is monitored by sensing engine manifold air pressure. The electronic controller has a shift parameter matrix stored within a programmable memory for comparing engine speed and engine load data to generate the control signal. The system can also have a manual override switch to override shifting of the shifting mechanism.

U.S. Pat. No. 6,234,853 discloses a docking system which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system uses two marine propulsion units to respond to an operator's command signal and allows the operator to select forward or reverse commands in combination with clockwise or counterclockwise rotational commands either in combination with each other or alone.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,511,354 discloses a multi-purpose control mechanism that allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second and third secondary control signals relating to desired maneuvers of the marine vessel.

U.S. Pat. No. 7,131,385 discloses a method for controlling the movement of a marine vessel that comprises steps that rotate two marine propulsion devices about their respective axes in order to increase the hydrodynamic resistance of the marine propulsion devices as they move through the water with the marine vessel. This increased resistance exerts a braking thrust on the marine vessel. Various techniques and procedures can be used to determine the absolute magnitudes of the angular magnitudes by which the marine propulsion devices are rotated.

U.S. Pat. No. 7,267,068 discloses a marine vessel that is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 7,305,928 discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station-keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,467,595 discloses a method for controlling the movement of a marine vessel that rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, traction control systems are for a marine vessel. The traction control systems can comprise a first internal combustion engine having an output that causes rotation of a first propulsor to thereby propel the marine vessel in water and a second internal combustion engine having an output that causes rotation of a second propulsor to thereby propel the marine vessel in the water. A sensor senses a change in operation of the first internal combustion engine that is indicative of a loss of traction between the first propulsor and the water. A control circuit is programmed to cause a reduction in the output of the first internal combustion engine when the sensor senses the change in operation of the first internal combustion engine, thereby allowing the first propulsor to regain traction with the water. When the control circuit causes a reduction in the output of the first internal combustion engine, the control circuit is further programmed to cause a reduction in the output of the second internal combustion engine, to thereby prevent unintended movement of the marine vessel.

In certain examples, the control circuit is programmed to temporarily slow rotation of the first propulsor when the sensor senses the change in operation of the first internal combustion engine, thereby allowing the first propulsor to regain traction with the water. When the control circuit slows rotation of the first propulsor, the control circuit is further programmed to temporarily slow rotation of the second propulsor, thereby preventing unintended movement of the marine vessel.

In certain examples, methods are for controlling a marine propulsion control system for a marine vessel in the water. The methods can comprise: (1) operating a first internal combustion engine to provide an output that causes rotation of a first propulsor to thereby propel the marine vessel in the water; (2) operating a second internal combustion engine to provide an output that causes rotation of a second propulsor to thereby propel the marine vessel in the water; (3) sensing a change in operation of the first internal combustion engine that is indicative of a loss of traction between the first propulsor and the water; (4) reducing the output of the first internal combustion engine when the change in operation of the first internal combustion engine is sensed, thereby allowing the first propulsor to regain traction with the water; and (5) reducing in the output of the second internal combustion engine when the output of the first internal combustion engine is reduced, to thereby prevent unintended movement of the marine vessel.

BRIEF DESCRIPTION OF THE DRAWINGS

Examples of systems and methods for controlling marine propulsion systems in marine vessels are described with reference to the following figures. The same numbers are used throughout the figures to reference like features and like components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

Figure 4:
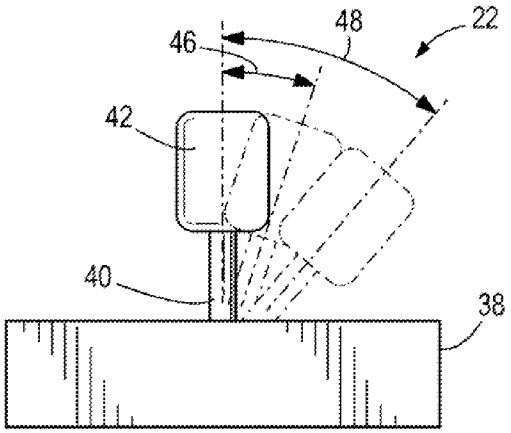
FIG. 4 is a view like FIG. 3 showing movement of the joystick.
Figure 5:
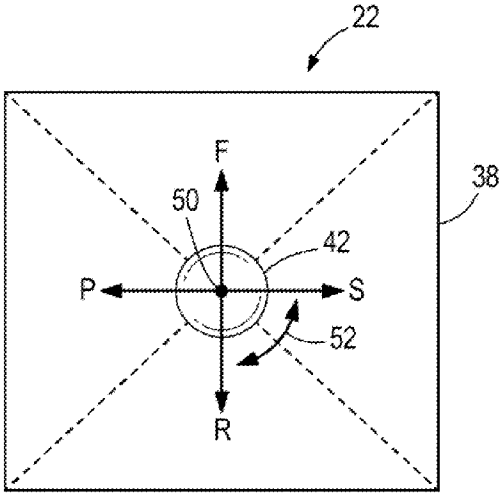
FIG. 5 is a top view of the joystick.
Figure 6:
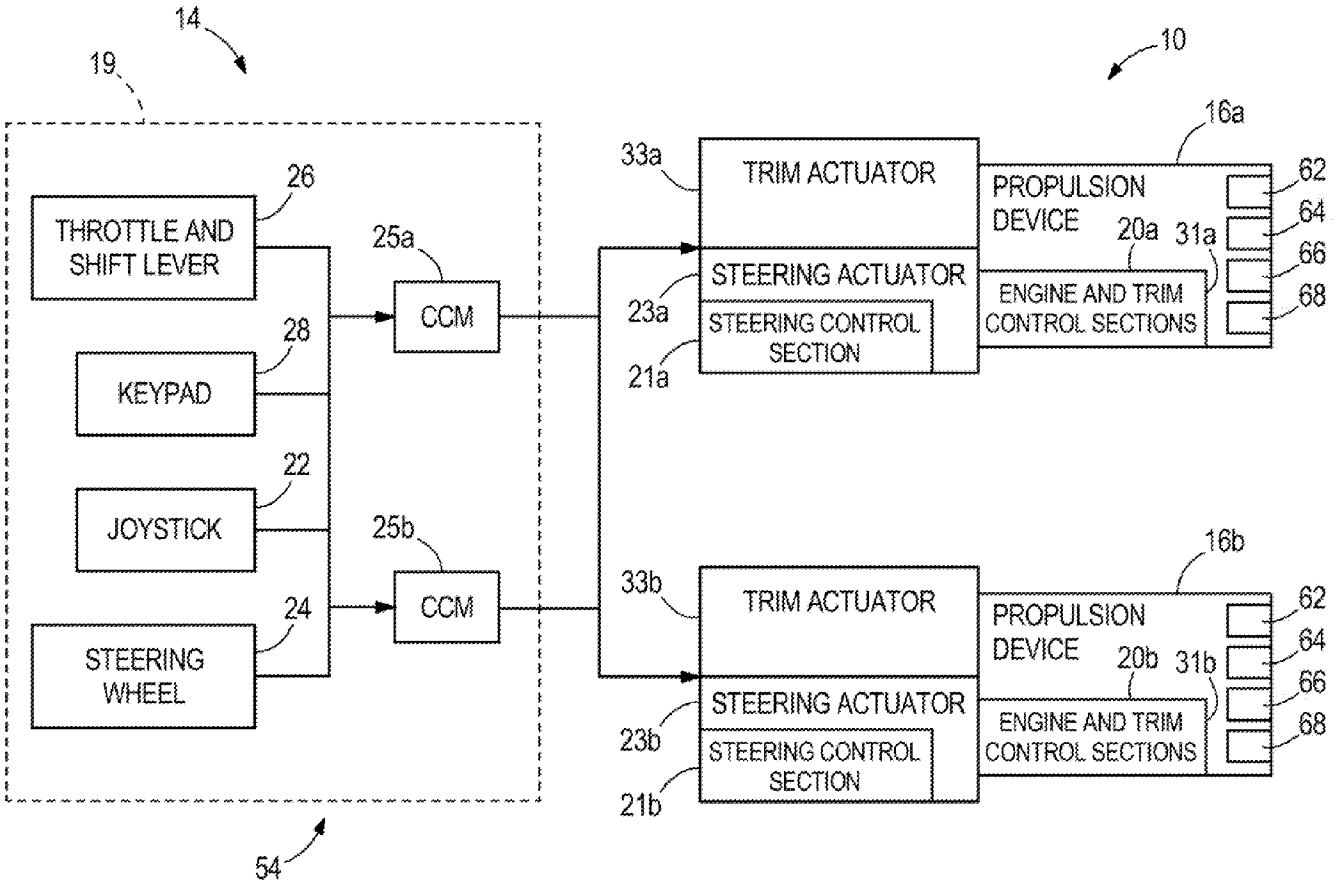
FIG. 6 is a schematic depiction of a control circuit for controlling a plurality of marine propulsion devices.

FIGS. 1-6 depict components of systems 10 for maneuvering and orienting a marine vessel 12. The system 10 includes, among other things, a control circuit 14 (see FIG. 6) for controlling the rotational position, trim position, and thrust generation of a plurality of marine propulsion devices 16*a*, 16*b* based upon inputs from an input device. FIG. 6 shows the control circuit 14 for a dual-propulsion device arrangement. It should be understood that the particular configurations of the system 10 and marine vessel 12 are exemplary. It is possible to apply the concepts described in the present disclosure with substantially different configurations for systems for maneuvering and orienting marine vessels and with substantially different marine vessels.

For example, the control circuit 14 (see e.g. FIGURE) is shown in schematic form and has a plurality of command control sections 25*a*, 25*b* located at a helm 19 of the marine vessel 12 that communicate with respective engine control sections 20*a*, 20*b* associated with each marine propulsion device 16*a*, 16*b*; steering control sections 21*a*, 21*b* associated with steering actuators 23*a*, 23*b* for steering each marine propulsion device 16*a*, 16*b*; and trim control sections 31*a*, 31*b* associated with trim actuators 33*a*, 33*b* for changing the trim angles of each marine propulsion device 16*a*, 16*b*. However, the control circuit 14 can have any number of sections (including for example one section) and can be located remotely from or at different locations in the marine vessel 12 from that shown. For example, the trim control sections 31*a*, 31*b* can be co-located with and/or part of the engine control sections 20*a*, 20*b* (as shown); or can be located separately from the respective engine control sections 20*a*, 20*b*. Other similar modifications of this type can be made. It should also be understood that the concepts disclosed in the present disclosure are capable of being implemented with different types of control systems, including systems that acquire global position data and real time positioning data, such as for example global positioning systems, inertial measurement units, and/or the like.

Further, certain types of input devices such as a joystick 22, a steering wheel 24, a shift and throttle lever 26, and a keypad 28 are described. It should be understood that the present disclosure is applicable with other numbers and types of input devices such as video screens, touchscreens, voice command modules, and the like. It should also be understood that the concepts disclosed in the present disclosure are able to function in a preprogrammed format without user input or in conjunction with different types of input devices, as would be known to one of ordinary skill in the art. Further equivalents, alternatives and modifications are possible as would be recognized by one of ordinary skill in the art.

Further, in the examples shown, marine vessels 12 have two (i.e. port and starboard) marine propulsion devices;

however, the concepts of the present disclosure are applicable to marine vessels having more than two marine propulsion devices. Parts of this disclosure and claims refer to a "propulsion device". These descriptions are intended to equally apply to arrangements having "one or more propulsion devices." The concepts in the present disclosure are applicable to marine vessels having any type or configuration of propulsion device, such as for example internal combustion engines and/or hybrid systems configured as an inboard drive, outboard drive, inboard/outboard drive, stern drive, and/or the like. The propulsion devices can operate any different type of propulsor such as propellers 18*a*, 18*b*, impellers, pod drives and/or the like.

Figure 2:
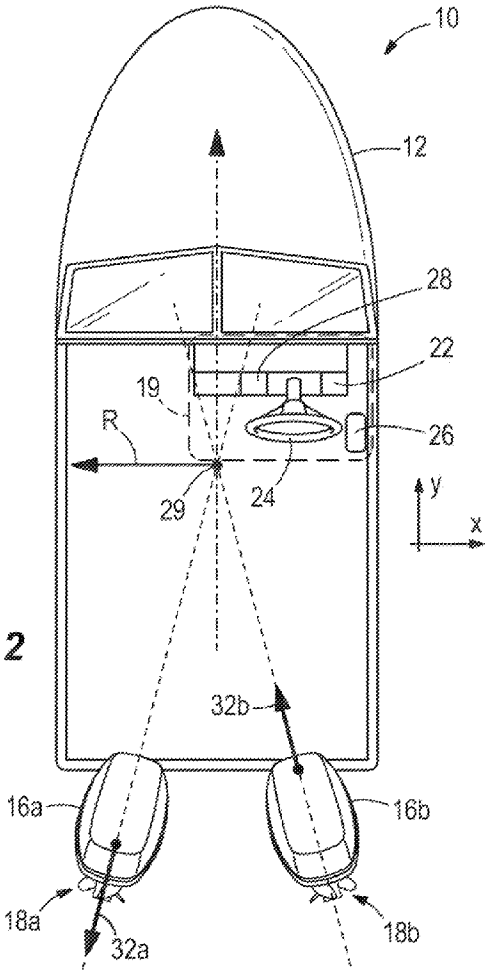
FIG. 2 is schematic depiction of a marine vessel having the plurality of marine propulsion devices wherein port and starboard propulsion devices are oriented inwardly towards a common point so as to provide thrusts that are both oriented along axes that intersect with the common point.
Figure 1:
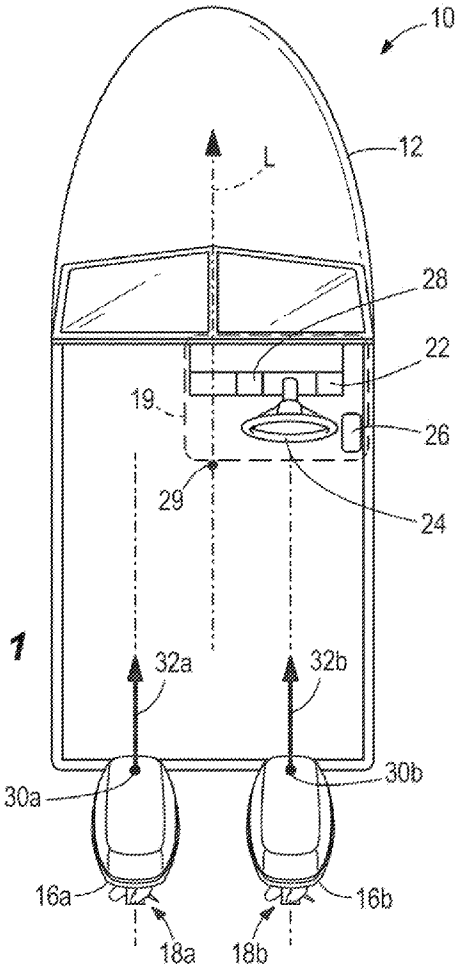
FIG. 1 is a schematic depiction of a marine vessel having a plurality of marine propulsion devices oriented in an aligned position wherein the propulsion devices can provide forward and reverse thrusts that are oriented along axes that are parallel to a longitudinal axis of the marine vessel.

In FIGS. 1 and 2, a marine vessel 12 is schematically illustrated and has port and starboard propulsion devices 16*a*, 16*b* which in the example shown include internal combustion engines in outboard motor arrangements. Again, the type and number of propulsion devices can vary from that shown. The marine propulsion devices 16*a*, 16*b* are each rotatable in clockwise and counterclockwise directions through a substantially similar range of rotation about respective steering axes 30*a*, 30*b*. Rotation of the marine propulsion devices 16*a*, 16*b* is facilitated by conventional steering actuators 23*a*, 23*b* (see FIG. 6). Steering actuators for rotating marine propulsion devices are well known in the art, examples of which are provided in U.S. Pat. No. 7,467,595, the disclosure of which is hereby incorporated by reference in entirety. Each marine propulsion device 16*a*, 16*b* creates propulsive thrust in both forward and reverse directions. FIG. 1 shows the marine propulsion devices 16*a*, 16*b* operating in forward gear, such that resultant forwardly acting thrust vectors 32*a*, 32*b* on the marine vessel 12 are produced; however, it should be recognized that the propulsion devices 16*a*, 16*b* could also be operated in reverse gear and thus provide oppositely oriented (and/or reversely acting) thrust vectors on the vessel 12.

As shown in FIG. 1, the propulsion devices 16*a*, 16*b* are aligned with a longitudinal axis L to thereby define the thrust vectors 32*a*, 32*b* extending in the direction of longitudinal axis L. The particular orientation of propulsion devices 16*a*, 16*b* shown in FIG. 1 is typically employed to achieve a forward or backward movement of the marine vessel 12 in the direction of the longitudinal axis L or a rotational movement of the vessel 12 with respect to the longitudinal axis L. Specifically, operation of the propulsion devices 16*a*, 16*b* in forward gear causes the marine vessel 12 to move forwardly in the direction of the longitudinal axis L. Conversely, operation of propulsion devices 16*a*, 16*b* in reverse gear causes the marine vessel 12 to move reversely in the direction of the longitudinal axis L. Further, operation of one of propulsion devices 16*a*, 16*b* in forward gear and the other in reverse gear causes rotation (yaw) of the marine vessel 12 about a center of turn 29 for the marine vessel 12. These and other various other maneuvering strategies and mechanisms are described in U.S. Pat. Nos. 6,234,853; 7,267,068; and 7,467,595; which are incorporated herein by reference.

In this example, the center of turn 29 represents an effective center of gravity for the marine vessel 12. However it will be understood by those having ordinary skill in the art that the location of the center of turn 29 is not, in all cases, the actual center of gravity of the marine vessel 12. That is, the center of turn 29 can be located at a different location than the actual center of gravity that would be calculated by analyzing the weight distribution of various components of the marine vessel 12. Maneuvering a marine vessel 12 in a body of water results in reactive forces exerted against the hull of the marine vessel 12 by the wind and the water. For example, as various maneuvering thrusts are exerted by the marine propulsion devices 16*a*, 16*b* the hull of the marine vessel 12 pushes against the water and the water exerts a reaction force against the hull. As a result, the center of turn identified at 29 in FIGS. 1 and 2 can change in response to different sets of forces and reactions exerted on the hull of the marine vessel 12. This concept is recognized by those skilled in the art and is referred to as the instantaneous center of turn in U.S. Pat. No. 6,234,853; and as the instantaneous center in U.S. Pat. No. 6,994,046, which are incorporated herein by reference.

As shown in FIG. 2, the marine propulsion devices 16*a* and 16*b* are rotated out of the aligned position shown in FIG. 1 so that the marine propulsion devices 16*a*, 16*b* and their resultant thrust vectors 32*a*, 32*b* are not aligned parallel with each other and with the longitudinal axis L. In the example shown in FIG. 2, the marine propulsion devices 16*a*, 16*b* are splayed inwardly and operated so as to provide thrust vectors 32*a*, 32*b* that extend along axes that transversely intersect with a common point, which in this example is the center of turn 29. FIG. 2 shows the marine propulsion device 16*a* being operated in reverse gear, thus causing resultant vector 32*a*, and the marine propulsion device 16*b* being operated in forward gear, thus causing resultant vector 32*b*. In addition to the example shown in FIG. 2, various other transversely oriented, unaligned positions and relative different or the same amounts of thrust of the marine propulsion devices 16*a*, 16*b* are possible to achieve one or both of a rotational movement and movement of the marine vessel 12 in any direction, including transverse to and parallel to the longitudinal axis L.

The marine vessel 12 also includes a helm 19 (see e.g. FIG. 6) where a user can input commands for maneuvering the marine vessel 12 via one or more input devices. As discussed above, the number and type of input devices can vary from the example shown. In FIGS. 1 and 2, the input devices include the joystick 22, steering wheel 24, shift and throttle lever 26 and keypad 28. Rotation of the steering wheel 24 in a clockwise direction requests clockwise rotation or yaw of the marine vessel 12 about the center of turn 29. Rotation of the steering wheel 24 in the counterclockwise direction requests counterclockwise rotation or yaw of the marine vessel 12 about the center of turn 29. Forward pivoting of the shift and throttle lever 26 away from the neutral position requests forward gear and requests increased throttle. Rearward pivoting of the shift and throttle lever 26 away from a neutral position requests reverse gear and requests increasing rearward throttle. Actuation of the keypad 28 inputs user-requested operational mode selections to the control circuit 14.

Figure 3:
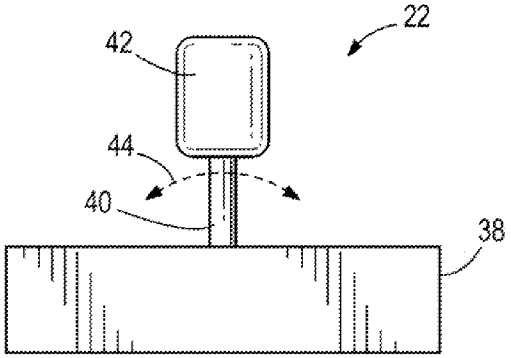
FIG. 3 is a side view of an input device in the form of a joystick.

A schematic depiction of a joystick 22 is depicted in FIGS. 3-5. The joystick 22 includes a base 38, a shaft 40 extending vertically upwardly relative to the base 38, and a handle 42 located on top of the shaft 40. The shaft 40 is movable, as represented by dashed-line arrow 44 in numerous directions relative to the base 38. FIG. 4 illustrates the shaft 40 and handle 42 in three different positions which vary by the magnitude of angular movement. Arrows 46 and 48 show different magnitudes of movement. The degree and direction of movement away from the generally vertical position shown in FIG. 3 represents an analogous magnitude and direction of an actual movement command selected by a user. FIG. 5 is a top view of the joystick 22 in which the handle 42 is in a central, vertical, or neutral position. The handle 42 can be manually manipulated in a forward F, reverse R, port P or starboard S direction or a combination of these to provide actual movement commands into F, R, P, S directions or any other direction therebetween. In addition, the handle 42 can be rotated about the centerline 50 of the shaft 40 as represented by arrow 52 to request rotational movement or yaw of the vessel 12 about the center of turn 29. Clockwise rotation of the handle 42 requests clockwise rotation of the marine vessel 12 about the center of turn 29, whereas counterclockwise rotation of the handle 42 requests counterclockwise rotation of the vessel about the center of turn 29. These and various other joystick structures and operations are described in the incorporated U.S. Pat. Nos. 6,234,853; 7,267,068; and 7,467,595.

Referring to FIG. 6 the input devices 22, 24, 26 and 28 communicate with the control circuit 14, which in the example shown is part of a network 54 connected via a network (CAN) bus. It is not required that the input devices 22, 24, 26 and 28 communicate with the control circuit 14 via the network 54. For example, one or more of these items can be connected to the control circuit 14 by hard wire or wireless connection. The control circuit 14 is programmed to control operation of marine propulsion devices 16*a*, 16*b* and the steering actuators and trim actuators associated therewith. As discussed above, the control circuit 14 can have different forms. In the example shown, the control circuit 14 includes a plurality of command control sections 25*a*, 25*b* located at the helm 19. A command control section 25*a*, 25*b* is provided for each of the port, starboard and intermediate marine propulsion devices 16*a*, 16*b*. The control circuit 14 also includes engine control sections 20*a*, 20*b* located at and controlling operation (i.e. output speed to the respective propulsor) of each respective propulsion device 16*a*, 16*b*; a steering control section 21*a*, 21*b*; located at and controlling operation of each steering actuator 23*a*, 23*b* and a trim control section 31*a*, 31*b* located at the respective engine control sections 20*a*, 20*b* and controlling operation of each trim actuator 33*a*, 33*b*. In another example, the trim control sections 31*a*, 31*b* can be located apart from the engine control sections 20*a*, 20*b* respectively. Each control section discussed herein optionally can have a memory and a processor for sending and receiving electronic control signals, for communicating with other control circuits in the network 54, and for controlling operations of certain components in the system 10 such as the operation and positioning of marine propulsion devices and related steering actuators and trim actuators. The structure and electrical connections of this type of system is within the skill of one having ordinary skill in the art, and is described in the incorporated U.S. Pat. No. 6,273,771. Examples of programming and operations of the control circuit 14 and its sections are described in further detail below with respect to non-limiting examples and/or algorithms. While each of these examples/algorithms includes a specific series of steps for accomplishing certain system control functions, the scope of this disclosure is not intended to be bound by the literal order or literal content of steps described herein, and non-substantial differences or changes still fall within the scope of the disclosure.

In the example shown, each command control section 25*a*, 25*b* receives user inputs via the network 54 from the joystick 22, steering wheel 24, shift and throttle lever 26, and keypad 28. As stated above, the joystick 22, steering wheel 24, shift and throttle lever 26, and keypad 28 can be wired directly to the command control sections 25*a*, 25*b* or via the network 54. Each command control section 25*a*, 25*b* is programmed to convert the user inputs into electronic commands and then send the commands to other control circuit sections in the system 10, including the engine control sections 20*a*, 20*b* and related steering control sections and trim control sections. For example, when the shift and throttle lever 26 is actuated, as described above, each command control section 25*a*, 25*b* sends commands to the respective engine control sections 20*a*, 20*b* to achieve the requested change in throttle and/or shift, which thereby outputs drive torque to a respective propulsor via a conventional driveshaft and transmission arrangement, all as is known. Rotation of the shift and throttle lever in the aftward direction will request reverse shift and thrust of the marine propulsion devices 16*a*, 16*b* to achieve reverse movement of the marine vessel 12. Further, when the steering wheel 24 is actuated, as described above, each command control section 25*a*, 25*b* sends commands to the respective steering control sections 21*a*, 21*b* to achieve the requested change in steering. When the joystick 22 is moved out of its vertical position, each command control section 25*a*, 25*b* sends commands to the respective engine control sections 20*a*, 20*b* and/or steering control sections 21*a*, 21*b* to achieve a movement commensurate with the joystick 22 movement. When the handle 42 of the joystick 22 is rotated, each command control section 25*a*, 25*b* sends commands to the respective steering control section 21*a*, 21 *b* to achieve the requested vessel yaw or rotation. Movement of the joystick 22 out of its vertical position effectively engages a "joystick mode" wherein the control circuit 14 controls operation and positioning of the marine propulsion devices 16*a*, 16*b* based upon movement of the joystick 22, as well as output of the marine propulsion devices 16*a*, 16*b* via output of the noted internal combustion engines to the propulsors. In another example, "joystick mode" can be actuated by user input to the keypad 28 or other input device.

Each propulsion device 16*a*, 16*b* can include conventional sensors 62, 64, 66, 68, each of which sense different operational characteristics of the internal combustion engines of the propulsion devices 16*a*, 16*b*. Such sensors can include an engine speed sensor 62 provided on the respective internal combustion engines. The engine speed sensor 62 can be a conventional device that senses speed (e.g. rotations per minute [RPM]) of the internal combustion engine 16*a*, 16*b*. The number, type and location of engine speed sensor 62 can vary and in one example can be a Hall Effect or Variable Reluctance sensor located at or near the encoder ring of the respective internal combustion engine. Such an engine speed sensor 62 is known in the art and commercially available for example from CTS Corporation or Delphi.

The sensor 64 optionally can include a manifold air pressure (MAP) for sensing air pressure in the intake manifold of the respective internal combustion engine. The number, type and location of the sensor 64 can vary and examples are commercially available for example from Kavlico (Model No. 8M6000639) or Delphi (Model No. 854445).

The sensor 66 optionally can include an intake air (IAT) sensor for sensing intake air to the respective internal combustion engines. The number, type and location of sensor 66 can vary, examples of which are conventional sensors that are commercially available for example from Thermometerics (Model Nos. 885342-002 or 889575) or Keihin (Model No. 891663-001).

The sensor 68 optionally can include a temperature and manifold pressure (TMAP) sensor for sensing temperature and manifold pressure of the respective internal combustion engine. The number, type and location of sensor 68 can vary, some examples of which are commercially available for example from Siemens VDT (Model No. 8M2001565) or General Motors (Model No. 885165).

Each of the sensors 62, 64, 66, 68 sense the noted engine characteristics and provide feedback to the control circuit 14, for example via the engine control sections 20*a*, 20*b* and/or command control sections 25*a*, 25*b*. The control circuit 14 is programmed to selectively utilize data from the noted sensors 62, 64, 66, 68 according to the embodiments described herein.

During research and experimentation, the present inventors have identified a problem with respect to operation and control of prior art systems for controlling movement of a marine vessel, and particularly for controlling movement of a marine vessel during the sidle and reverse translations described herein above. Particularly, during operation prior art systems to obtain sidle and/or reverse movements, at least one of the marine propulsion devices usually is operated in reverse gear and typically at relatively low speeds. During such operation, surface air or exhaust gas can interact with the propulsor, for example with the blades of a propeller. When this occurs, the speed of the particular internal combustion engine that is outputting torque to the propulsor climbs rapidly. This is due to a loss of engagement between the blades of the propeller and the water caused by the air or exhaust gas. This is often referred to in the art as "ventilation". Ventilation most commonly occurs during operation of a marine propulsion device in reverse gear and at low speeds due to exhaust gases being emitted from the internal combustion engine housing of the propulsor. Referring to FIG. 2, the inventors have determined that ventilation occurring, for example, at the internal combustion engine 18*a* of the propulsion devices 16*a* can cause a redirection of the resultant vector R on the marine vessel 12, thus resulting in movement of the marine vessel 12 in an unintended direction, e.g. a direction other than the direction requested via the input devices or the control circuit. This unintended movement can be unsettling to the operator. The present inventors have determined that it is desirable to provide a system that automatically and effectively overcomes the effects of internal combustion engine ventilation, especially during joysticking operations.

As described herein with respect to non-limiting examples, the present disclosure provides traction control systems for marine vessels 12 disposed in water. In certain examples, the control circuit 14 is programmed to recognize a situation in which ventilation of one or more propulsors is occurring, to rectify the situation by temporarily lowering the speed of the internal combustion engine providing output power to the ventilating propulsor, and thereafter to return the internal combustion to the original output power once the ventilation ceases. These steps can be automatically taken by the control circuit, without operator input or control. Effectively the control circuit lowers the speed of rotation of the propulsor that is encountering ventilation so that the propulsor is able to gain traction with the water, and then returns the speed of rotation of the propulsor to the original speed. Advantageously, in order to avoid unexpected movement of the marine vessel, the control circuit also can be programmed to simultaneously lower the speed of the remaining internal combustion engine(s) in the plurality by a commensurate amount, so that the direction of the resultant vector (e.g. "R") does not change. This prevents unexpected change in direction (e.g. unexpected movement) of the vessel 12. The amounts that the respective outputs of the internal combustion engines are changed by the control circuit can vary and can be calibrated amounts based upon the particular system. The amount of change to the output of the internal combustion engine powering the propulsor that is encountering ventilation can be different than the amount of change to the output of the internal combustion engine powering the remaining propulsor(s) in the plurality. Typically the propulsor that is being operated in reverse is the propulsor that encounters ventilation, whereas the propulsor (s) operated in forward gear does not. However this is not always the case.

Referring to the Figures, the present disclosure provides a traction control system 10 that includes the first internal combustion engine (i.e. as part of the marine propulsion device 16*a*), which has an output that causes rotation of a first propulsor (i.e. propeller 18*a* via conventional drive shaft and transmission combination) to thereby propel the marine vessel 12 in the water. A second internal combustion engine (i.e. as part of the marine propulsion device 16*b*) has an output that causes rotation of a second propulsor (i.e. propeller 18*b* via conventional drive shaft and transmission combination) to thereby propel the marine vessel 12 in the water. A sensor (e.g. one or more of sensors 62, 64, 66, 68) senses a change in operation of the first internal combustion engine 16*a* that is indicative of a loss of traction (i.e. ventilation) between the first propulsor 18*a* and the water. The sensor 62, 64, 66 and/or 68 senses the noted change in operation of the first internal combustion engine 16*a* by sensing a change in an engine characteristic that can include, for example, a change in engine speed, a rate of change of engine speed, and/or a change in demand (air flow) to the respective internal combustion engine. As further explained herein below, the control circuit 14 is programmed to determine that the loss of traction (via e.g. ventilation) between the first propulsor 18*a* and the water has occurred based upon a comparison of the noted engine characteristic to a threshold stored in memory. For example, if the engine characteristic has a value that exceeds the threshold, the control circuit 14 determines that ventilation has occurred. The control circuit 14 is further programmed to cause a reduction in the output of the first internal combustion engine 16*a* when the sensor 62, 64, 66 and/or 68 senses the noted change in operation of the first internal combustion engine 16*a*, thereby allowing the first propulsor 18*a* to regain traction with the water. The control circuit 14 is further programmed to cause a commensurate and/or proportional reduction in the output of the second internal combustion engine 16*b*, to thereby prevent the unintended movement of the marine vessel 12 described herein above. The change (reduction) in output of the second internal combustion engine 16*b* can be caused at the same time as the reduction in output of the first internal combustion engine 16*a*.

As explained hereinabove, during joystick or stationkeeping operations, ventilation typically will occur with respect to the propulsor that is operated in reverse gear, whereas the propulsor that is operated in forward gear typically does not lose traction with the water. Therefore the simultaneous reduction in speed of both propulsors by commensurate and/or proportional amounts allows the system 10 to maintain the current course/heading of the marine vessel 12 (shown e.g. at R in FIG. 2) according to the conventional control algorithms described in the above-incorporated U.S. patents. The commensurate and/or proportional amount can be calibrated based upon the physical characteristics of the vessel 12 and system 10 and the vectoring algorithms which are known in the art and disclosed in the above-referenced patents.

The propulsion device that is being operated in reverse gear and encountering ventilation typically is operated at a higher speed than the propulsion device being operated in forward gear. Therefore, the requisite reduction in output of the internal combustion engine driving the propulsor that is operated in reverse gear typically is more than the reduction in output of the internal combustion engine driving the propulsor that is being operated in forward gear. In FIG. 2, the output of the reversely operated first internal combustion engine 16*a* (i.e. 32*a*) often can be more than the output of the forwardly operated second internal combustion engine 16*b* (i.e. 32*b*), and therefore the amount of reduction of the output of the first internal combustion engine 16*a* is often more than the amount of reduction in output of the second internal combustion engine 16*b*. For example, if the control circuit 14 reduces the output (or speed) of the first internal combustion engine 16*a* by 50% to eliminate ventilation, the control circuit 14 can be programmed to reduce the output (or speed) of the second internal combustion engine 16*b* by 50%, as well. In other words, if the propulsor 18*a* encounters cavitation, the output (or speed) of each internal combustion engine 16*a*, 16*b* will be reduced by the control circuit 14 by an amount that is proportional to the ratio of forward to reverse thrust (based on known propulsor thrust data) to a level at which the propulsor 18*a* regains "traction", and then the control circuit 14 will increase the output (or speed) back to the original set point. This will achieve a constant resultant vector R during the reduction. The control circuit 14 can be programmed to reduce the outputs of the first and second internal combustion engines 16*a*, 16*b* for a certain/predetermined period of time, where after the outputs are returned to the state of operation prior to the reduction. Therefore, according to the present disclosure, a control circuit 14 is provided that temporarily slows rotation of the first propulsor 18*a*, which is encountering ventilation, as indicated by the sensor 62, 64, 66 and/or 68. This allows the first propulsor 18*a* to regain traction with the water. Simultaneously, the control circuit 14 is further programmed to temporarily slow rotation of the second propulsor 18*b*, thereby preventing unintended movement of the marine vessel 12. Thereafter, the respective speeds of the propulsors 18*a*, 18*b* can be reinstated.

Figure 7:
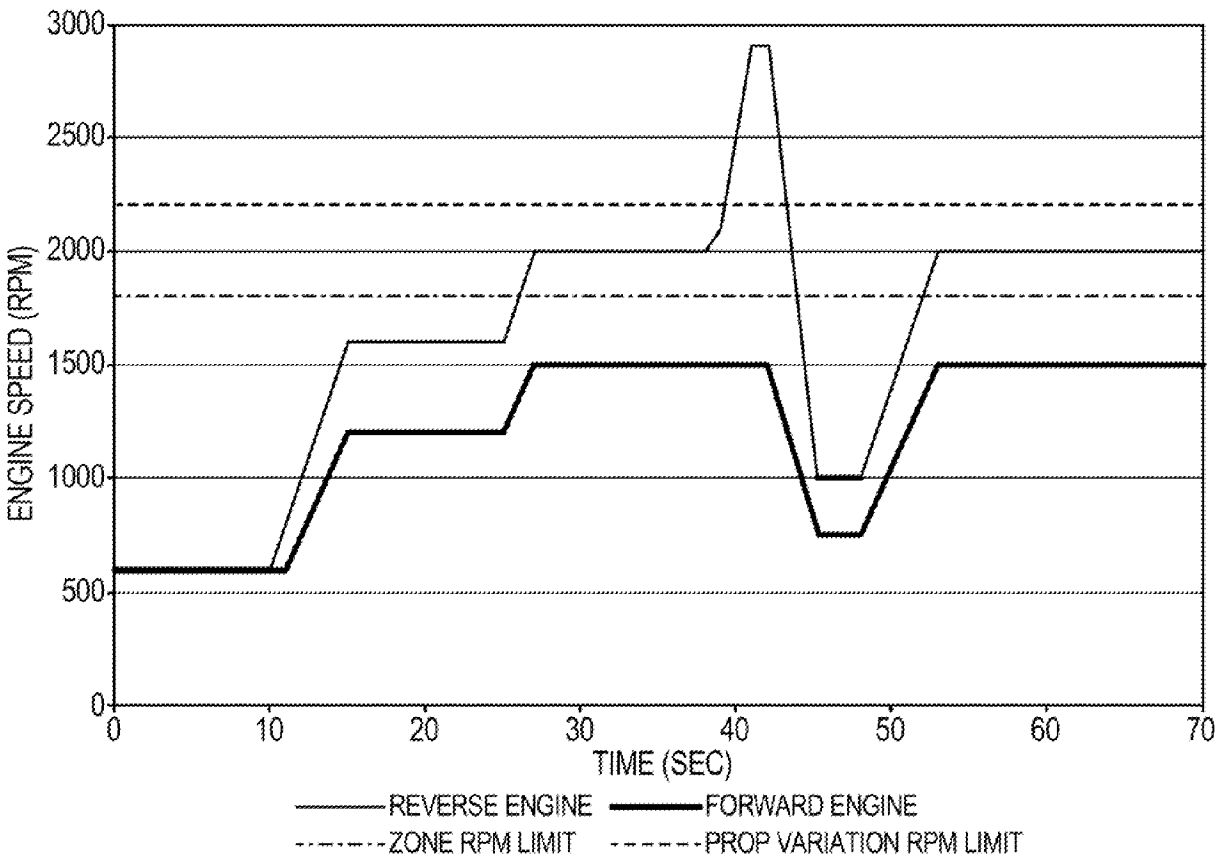
FIG. 7 is a graph depicting internal combustion engine speed (Y-axis) vs. time (X-axis).

FIG. 7 is a graph depicting non-limiting example of the above-described actions of the control circuit 14. In this example, the control circuit 14 monitors the speed of rotation of the propulsor 18*a*, as caused by output of the internal combustion engine 16*a*. Once the speed of rotation of the propulsor 18*a* exceeds a propulsor variation RPM limit, which is stored in the memory of the control circuit 14, the control circuit 14 causes a reduction in output of the first internal combustion engine 16*a*, thereby slowing speed of rotation of the first propulsor 18*a*, which allows the first propulsor 18*a* to regain traction with the water. Simultaneously, the control circuit 14 causes a reduction in the output of the second internal combustion engine 16*b*, thereby slowing the speed of rotation of the second propulsor 18*b* by a commensurate or proportional amount, thus preventing unintended movement (i.e. a change in movement that is not requested by the operator) of the marine vessel 12. In other words, the speed of the second propulsor 18*b* is reduced so that the resultant vector R does not change. Thereafter, the control circuit 14 simultaneously increases the outputs of the first and second internal combustion engines 16*a*, 16*b* to restore the internal combustion engines 16*a*, 16*b* to the original outputs prior to the reduction. This process can automatically be conducted when the control circuit 14 detects the noted change in operation of one of the internal combustion engines.

The example shown in FIG. 7 is based upon engine speed, as sensed by the noted engine speed sensor 62. This is a non-limiting example. In other examples, the system 10 can function in the above-described manner based upon input(s) from any one or more of the sensors 62, 64, 66 and/or 68. For example, the control circuit 14 can operate based upon input from the engine speed sensor 62, wherein the control circuit 14 determines whether a rate of change of speed of the first internal combustion engine 16*a* exceeds a threshold. If the rate of change of RPM exceeds the threshold, the control circuit 14 can be programmed to reinstate traction to the propulsor, as described herein above, and reduce the speed of the second propulsor 18*b* so that the resultant vector R does not change. In other examples, the control circuit 14 can be programmed to operate based upon demand/air flow of the first internal combustion engine. For example, the control circuit 14 can be programmed to determine that ventilation is occurring if the demand/air flow for the particular internal combustion engine is low, but the speed of the engine (RPM) is high. The demand/air flow can be calculated as follows.

$$APC = \frac{\mathrm{MAP}[kPa]_\mathrm{Angle} * SweptcylVol[\mathrm{ml}]}{R\left[\frac{J}{kg * K}\right] * IAT[K]} * n_v(VolEff) * \mathrm{VE_Temp}(corr) * \mathrm{VE_Press}(corr)$$

APC=Air Per Cylinder
MAP_Angle=Manifold Air Pressure
Sweptcyl Vol==Cylinder Swept Volume
R=Gas Constant
IAT=Intake Air Temperature
VolEff=Volumetric Efficiency
VE_Temp=Temperature Correction based on IAT
VE_Press=Pressure Correction based on Baro (used for Altitude compensations)

If this is the case, the control circuit 14 can be programmed to reinstate traction to the propulsor, as described herein above, and simultaneously reduce the speed of the second propulsor 18*b* so that resultant vector R does not change.

Figure 8:
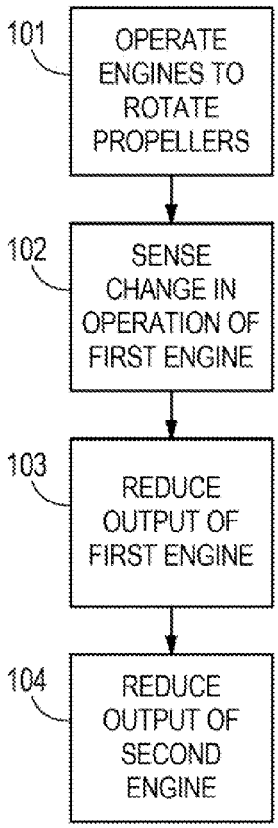
FIG. 8 is a flow chart depicting one example of a method according to the present disclosure.

FIG. 8 depicts one example of a method of controlling a marine propulsion control system in water. At step 101, first and second internal combustion engines are operated to provide outputs that cause rotation of first and second propulsors, to thereby propel a marine vessel in the water. At step 102, a change in operation of the first internal combustion is sensed, which is indicative of a loss of traction between the first propulsor and the water. At step 103, the output of the first internal combustion is reduced, thereby reducing the speed of rotation of the first propulsor, thereby allowing the first propulsor to regain traction with the water. At step 104, the output of the second internal combustion engine is reduced, thereby reducing the speed of rotation of the second propulsor, thereby preventing unintended movement of the marine vessel. As described herein above, the amount of reduction of the speed of rotation of the second propulsor will vary and is calculated by the control circuit based upon the amount of reduction of speed of rotation of the first propulsor according to vector analysis that is well known in the art and disclosed in the above-incorporated patents.

Figure 9:
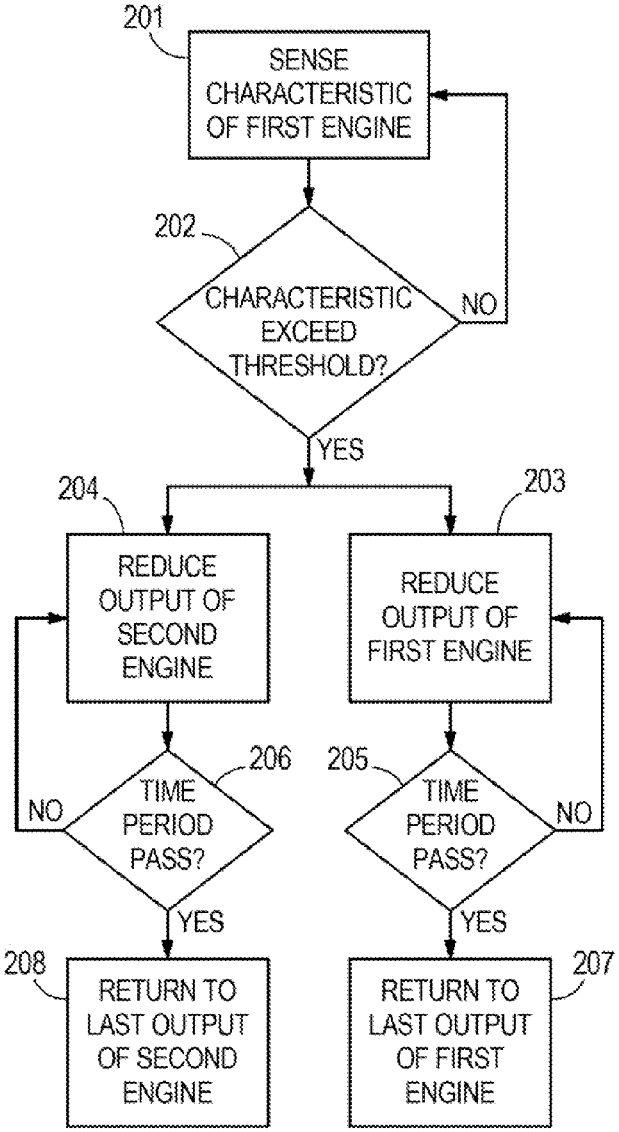
FIG. 9 is a flow chart depicting another example of a method according to the present disclosure.

FIG. 9 depicts another example of a method according to the present disclosure. At step 201, a change in operation of the first internal combustion engine is sensed, which is indicative of a loss of traction between the first propulsor and the water. At step 202, the control circuit determines whether the sensed characteristic exceeds a threshold that is stored in memory. If no, the method repeats step 201. If yes, the method proceeds to steps 203 and 204. At step 203, the control circuit reduces the output of the first internal combustion engine, thereby reducing the speed of rotation of the first propulsor. At step 204, the control circuit reduces the output of the second internal combustion engine, thereby reducing the speed of rotation of the second propulsor. At steps 205 and 206, the control circuit determines whether a predetermined or certain time period has passed during which the first propulsor is assumed to have regained traction with the water. The time periods at steps 205 and 206 can be the same. Once the time period is completed, at steps 207 and 208, the control circuit causes the first and second internal combustion engines to return to the output that was provided prior to the reduction at steps 203 and 204, thus returning the propulsors to their original speeds.

What is claimed is:

1. A traction control system for a marine vessel disposed in water, the traction control system comprising:

a first internal combustion engine having an output that causes rotation of a first propulsor to thereby propel the marine vessel in the water;

a second internal combustion engine having an output that causes rotation of a second propulsor to thereby propel the marine vessel in the water;

a sensor that senses a change in operation of the first internal combustion engine that is indicative of a loss of traction between the first propulsor and the water; and a control circuit that is programmed to cause a reduction in the output of the first internal combustion engine when the sensor senses the change in operation of the first internal combustion engine, thereby allowing the first propulsor to regain traction with the water;

wherein when the control circuit causes a reduction in the output of the first internal combustion engine, the control circuit is further programmed to cause a reduction in the output of the second internal combustion engine, to thereby prevent unintended movement of the marine vessel.

2. The system according to claim 1, wherein the sensor senses the change in operation of the first internal combustion engine by sensing an engine characteristic, and wherein the control circuit is programmed to determine that the loss of traction between the first propulsor and the water has occurred based upon a comparison of the engine characteristic to a threshold.

3. The system according to claim 2, wherein the sensor comprises a speed sensor and wherein the engine characteristic comprises a change of engine speed.

4. The system according to claim 2, wherein the sensor comprises a speed sensor and wherein the engine characteristic comprises a rate of change of engine speed.

5. The system according to claim 2, wherein the sensor comprises an engine airflow sensor and wherein the engine characteristic comprises a change of airflow.

6. The system according to claim 1, wherein the output of the first internal combustion engine drives the first propulsor in reverse gear and wherein the output of the second internal combustion engine drives the second propulsor in forward gear.

7. The system according to claim 6, wherein the output of the first internal combustion engine is more than the output of the second internal combustion engine; and wherein an amount of the reduction in the output of the first internal combustion engine is more than an amount of the reduction in output of the second internal combustion engine.

8. The system according to claim 1, wherein the control circuit is programmed to reduce the output of the first internal combustion engine for a predetermined time and wherein the control circuit is programmed to reduce the output of the second internal combustion engine for the predetermined time.

9. The system according to claim 1, comprising an input device that inputs to the control circuit a user request for the output of the first and second internal combustion engines.

10. The system according to claim 9, wherein the input device comprises a joystick.

11. A method of controlling a marine propulsion control system for a marine vessel in water, the method comprising:

operating a first internal combustion engine to provide an output that causes rotation of a first propulsor to thereby propel the marine vessel in the water;

operating a second internal combustion engine to provide an output that causes rotation of a second propulsor to thereby propel the marine vessel in the water;

sensing a change in operation of the first internal combustion engine that is indicative of a loss of traction between the first propulsor and the water;

reducing the output of the first internal combustion engine when the change in operation of the first internal combustion engine is sensed, thereby allowing the first propulsor to regain traction with the water; and reducing in the output of the second internal combustion engine when the output of the first internal combustion engine is reduced, to thereby prevent unintended movement of the marine vessel.

12. The method according to claim 11, further comprising sensing the change in operation of the first internal combustion engine by sensing an engine characteristic, and determining that the loss of traction between the first propulsor and the water has occurred based upon a comparison of the engine characteristic to a threshold.

13. The method according to claim 12, wherein the engine characteristic comprises a change of engine speed.

14. The method according to claim 12, wherein the engine characteristic comprises a rate of change of engine speed.

15. The method according to claim 12, wherein the engine characteristic comprises change of engine airflow.

16. The method according to claim 11, wherein the output of the first internal combustion engine drives the propulsor in reverse gear and wherein the output of the second internal combustion engine drives the propulsor in forward gear.

17. The method according to claim 16, wherein the output of the first internal combustion engine is more than the output of the second internal combustion engine; and wherein an amount of the reduction in the output of the first internal combustion engine is more than an amount of the reduction in the output of the second internal combustion engine.

18. The method according to claim 11, further comprising reducing the output of the first internal combustion engine for a predetermined time and reducing the output of the second internal combustion engine for said predetermined time.

19. The method according to claim 11, further comprising operating a user input device to input to the control circuit a user request for the output of the first and second internal combustion engines.

20. A traction control system for a marine vessel disposed in water, the traction control system comprising:

a first internal combustion engine that causes rotation of a first propulsor to thereby propel the marine vessel in the water;

a second internal combustion engine that causes rotation of a second propulsor to thereby propel the marine vessel in the water;

a sensor that senses a change in operation of the first internal combustion engine that is indicative of a loss of traction between the first propulsor and the water; and a control circuit that is programmed to temporarily slow rotation of the first propulsor when the sensor senses the change in operation of the first internal combustion engine, thereby allowing the first propulsor to regain traction with the water;

wherein when the control circuit slows rotation, the control circuit is further programmed to temporarily slow rotation of the second propulsor, thereby preventing unintended movement of the marine vessel.

* * * * *